US005850653A

United States Patent [19]

Mufti

[11] Patent Number: 5,850,653

[45] Date of Patent: Dec. 22, 1998

[54] PRE-CAST CONCRETE DECKING FOR LOAD SUPPORTING STRUCTURES

[76] Inventor: Aftab A. Mufti, 1267 Wright Avenue, Halifax, Nova Scotia, Canada, B3J 1C6

[21] Appl. No.: 805,830

[22] Filed: Feb. 26, 1997

[51] Int. Cl.[6] ..... E01D 19/12

[52] U.S. Cl. ..... 14/73; 14/1

[58] Field of Search ..... 14/73, 74.5, 77.1, 14/6, 1; 52/223.6, 334, 223.1, 223.8, 223.12; 404/43, 45, 70

[56] References Cited

U.S. PATENT DOCUMENTS

| | | | |
|---|---|---|---|
| 339,296 | 4/1886 | Jackson | 52/223.6 X |
| 3,210,900 | 10/1965 | Sattler | 52/334 |
| 4,972,537 | 11/1990 | Slaw, Sr. | 14/1 |
| 4,974,380 | 12/1990 | Bernander et al. | 52/235 |
| 5,339,475 | 8/1994 | Jaeger et al. | 14/73 |

*Primary Examiner*—Tamara L. Graysay
*Assistant Examiner*—Sunil Singh

[57] ABSTRACT

Pre-cast concrete panels for use as deck components in a load supporting structure are constructed of non-metallic fibre reinforced concrete. Integral, transverse tension members are located externally adjacent the lower support surfaces of the panels and connected to the panels at their outer ends. The tension members carry compression forces applied to the panels by supporting an arching action, thereby avoiding the need to provide steel reinforcement across the entire interior of the concrete. This, in turn, reduces the risks of panel failure due to the corrosion of reinforcement steel located within the body of the concrete panel.

7 Claims, 2 Drawing Sheets

PRE-CAST CONCRETE DECKING FOR LOAD SUPPORTING STRUCTURES

FIELD OF THE INVENTION

This invention relates to load supporting structures of the type in which pre-cast, concrete deck panels are supported by a pair of laterally spaced beams. The beams provide upper support surfaces on which the outer edges of the pre-cast concrete panels are located. More particularly, the invention relates to provision of external, tension-absorbing members embedded at their ends which strengthen the load carrying capacity of the concrete panels.

BACKGROUND TO THE INVENTION

In load supporting structures of the type in which a concrete deck is cast in place on a pair of laterally spaced beams, it is already known to restrain the upper support surfaces of the beams against relative lateral movement by providing transverse coupling means attached between the beams. A concrete deck is then cast in place on top of the beams, the concrete of the deck being impregnated with non-metallic fibres and devoid of steel reinforcement. Such decks are dimensioned to transfer loads imposed on the upper surface of the deck to the upper support surfaces of the beams through an arching action within the deck. The resistance of the beams to spreading or separation provides sufficient stiffness to the periphery of the deck to sustain compressive forces within the deck upon application of a load thereto.

U.S. Pat. No. 5,339,475 (Jaeger et al), the contents of which is incorporated herein by reference, specifically discloses that an arching action may be developed in a cast-in-place, non-metallic fibre reinforced, concrete deck supported by a pair of laterally spaced beams held together by tension members located between the beams and secured thereto.

However, the load supporting structure described in Jaeger et al may not be best suited to use in the repair of existing structures, the erection of temporary structures, or any application where it would be advantageous to fabricate concrete deck components remote from the site of installation.

Therefore an object of the present invention is to provide a system for the provision of pre-cast concrete panels for use as deck components in which system the panels are largely free of internal reinforcing steel, and to provide a method of developing arching action in such pre-cast panels without the necessity of providing separate, fixed transverse attachments between the beams supporting such panels.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

It has been discovered that it is possible to retain the necessary arching action within a pre-cast concrete deck panel by embedment of tension members only partially within the deck panel itself, avoiding the necessity of securing separate, transverse tension members to the laterally spaced beams.

According to the present invention, a pre-cast concrete panel, which may be used in a load supporting structure of the type in which a pair of laterally spaced beams extend between a pair of spaced vertical supports and the beams present upper support surfaces on which said panel may be located, comprises concrete impregnated with non-metallic fibres and spaced tension members provided at their outer ends with transversely extending anchor means which are embedded within the concrete at the outer edge portions of the concrete panel. The orientation of the tension members is lateral to and spans the gap between a pair of load transfer surfaces provided on the lower, outer edges of the panel and defining the bottom plane of the concrete panel. The concrete and the tension members are dimensioned to transfer loads imposed on the upper surface of said panel to the edge load transfer surfaces thereof through an arching action, and thence to the upper support surfaces of said beams. The tension members and their anchor means are located at or above the bottom plane of the concrete panel.

In a preferred embodiment of the invention a pre-cast concrete panel, intended to be used as an interior panel in a line of such panels, is substantially rectangular in plan form. Each panel is provided on opposed, lower, outer edges with load transfer surfaces that are substantially parallel to one another. These surfaces are located along opposed edges bounding an arched or elevated central region formed in the lower or under-surface of the panel.

The tension members preferably incorporate shear studs or anchoring means at or near their ends in order to facilitate the coupling of the members to the concrete and ensure the preservation of arching compression forces within the concrete in conjunction with the development of tension forces within the tension members.

It is a preferred feature that the panel should have its lower surface arched between the load transfer surfaces, in such a manner that the depth of concrete is greatest immediately over said load transfer surfaces and least mid-way therebetween. The outer ends of the tension members are embedded within the concrete of the panels in the region of greater depth of concrete immediately over the load transfer surfaces. The mid-portions of the tension members pass below the lower surface of the concrete in the regions of its shallower depth and are not embedded therein. The preference for having the tension embers embedded in the concrete over only a part of their length arises from the need to avoid corrosion of tension members which are located within the concrete in its thinner, central portions.

The pre-cast concrete panel is preferably connected to the pair of laterally spaced beams by means of spaced clusters of shear studs which are secured to the upper support surfaces of the beams, the shear studs being received into recesses in the lower, load transfer surfaces of the panel and secured therein by grouting.

According to a further feature of the invention a pre-cast concrete panel that is intended to be used as an end panel in a line of panels is substantially rectangular in plan form and presents downwardly directed, load transfer surfaces along three of its lower, peripheral edges. Two of the load transfer surfaces are substantially parallel to one another, located in the same manner as occurs in an interior panel. The third load transfer surface extends laterally between the pair of spaced beams in the bottom plane of the concrete panel so as to be capable of being located on an upper support surface of a transverse beam secured to and extending laterally between the parallel spaced beams at the point where the decking is to terminate. The lower surface of such an end panel transitions from an arched or elevated region in the center of the panel to the plane of the three peripheral edges as the under surface of the end panel meets with the third load transfer surface.

The foregoing summarizes the principal features of the invention and some of its optional aspects. The invention may be further understood by the description of the preferred embodiments, in conjunction with the drawings, which now follow.

SUMMARY OF THE FIGURES

Embodiments of the invention will now be described by way of example only with reference to the following drawings, in which.

DESCRIPTION OF THE PREFERRED EMBODIMENT

Figure 1:
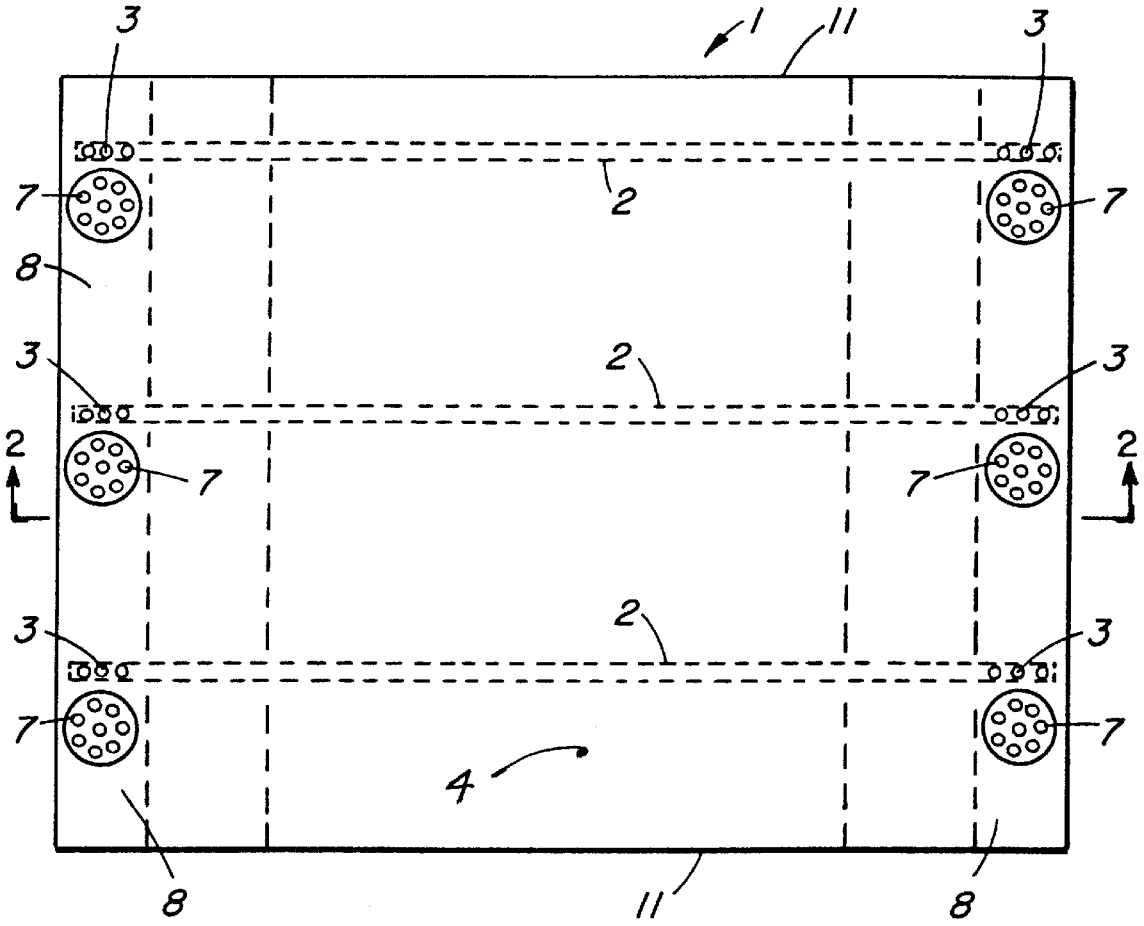
FIG. 1 is a plan view of an interior pre-cast concrete panel.
Figure 2:
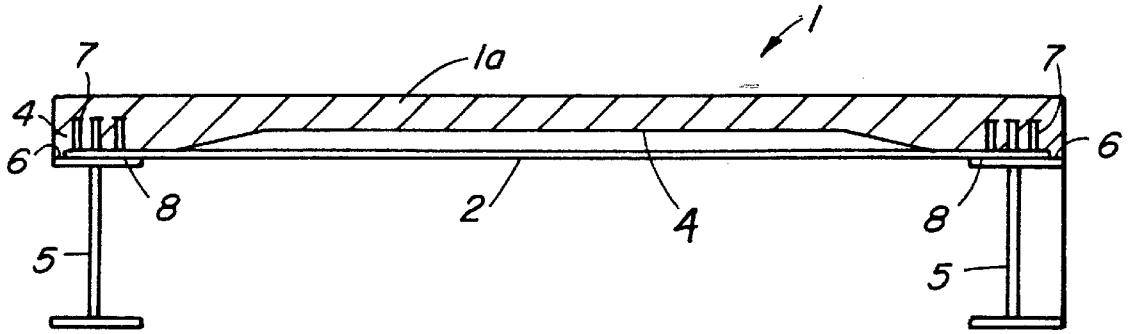
FIG. 2 is a transverse cross-section of an interior pre-cast concrete panel.

FIGS. 1 and 2 show respectively a plan view and a transverse cross sectional view of a load-supporting structure incorporating a pre-cast concrete panel containing non-metallic reinforcing fibers that serves as an interior panel.

Figure 4:
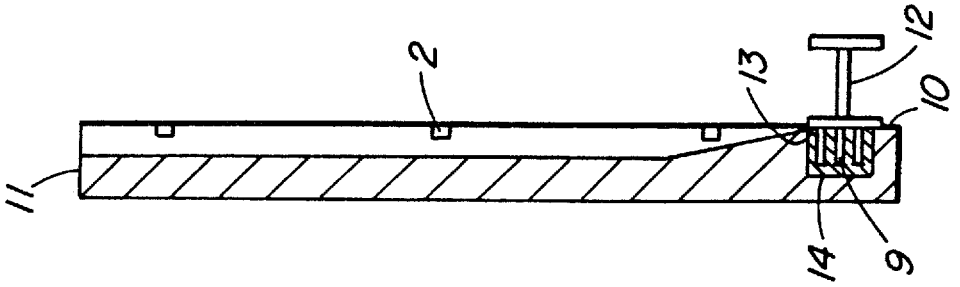
FIG. 4 is a longitudinal cross-section of a terminator, or end panel.
Figure 3:
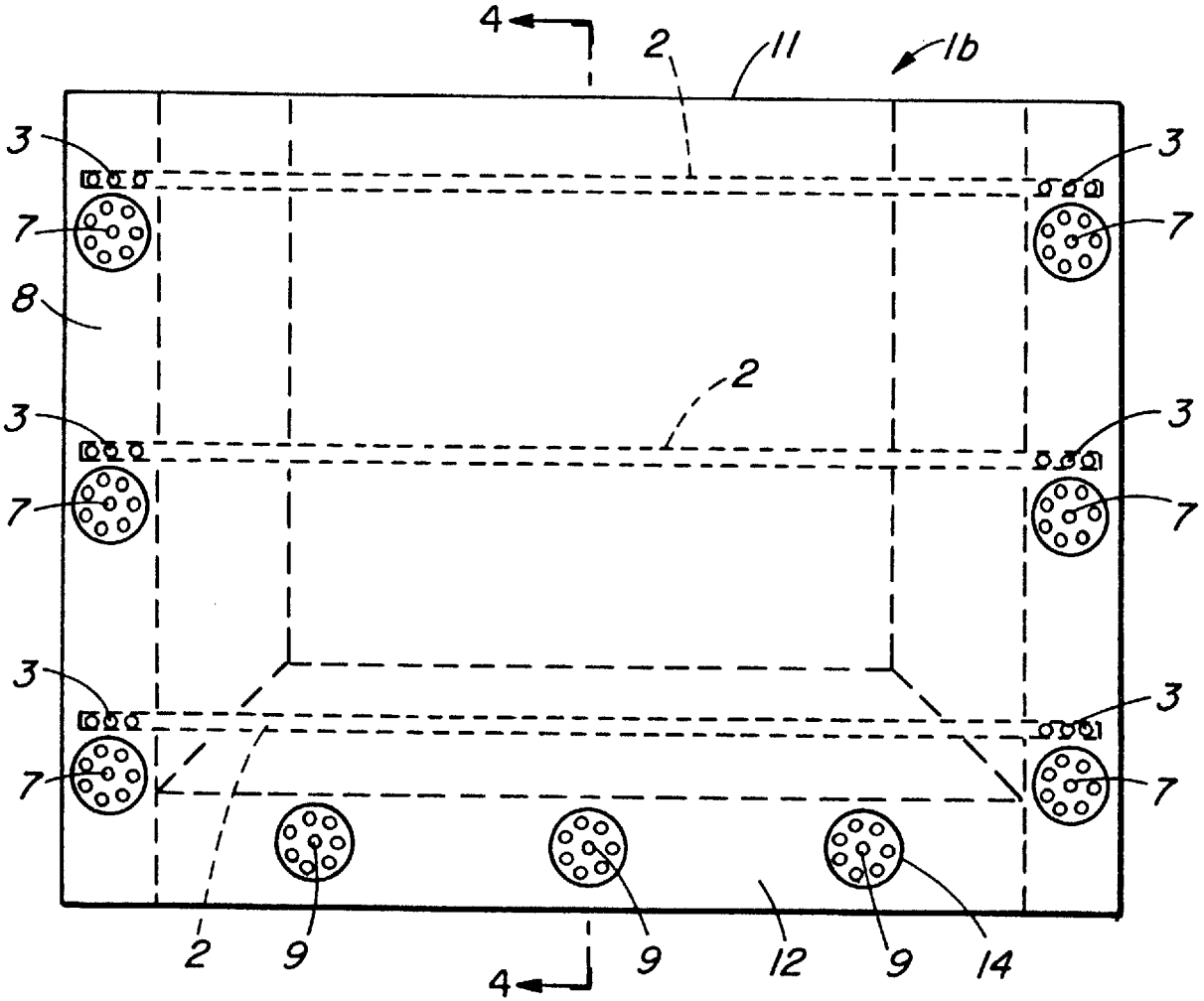
FIG. 3 is a plan view of a terminator, or end panel.

FIGS. 3 and 4 show, respectively, a plan view and a longitudinal cross section of an end panel.

The rectangular pre-cast concrete panel 1 comprises a concrete body impregnated with non-metallic fibres and spaced tension members 2 with transversely extending anchor means 3 at their outer ends. These anchor means are embedded in and bonded to the outer lower edge portions of the concrete body which provide lower edge load transfer surfaces for the panels. Such tension members 2 are shown as steel plates or bars which lie at or above the common bottom plane of the panel as defined by lower edge, load transfer surfaces. They may, however, be formed of any suitable tension sustaining material. The concrete body of the panel 1 is otherwise preferably free of corrosion-susceptible metal, such as steel wire.

The non-metallic fibres are preferably made of aramid or polypropylene, or other equivalent material, distributed within the concrete with greater than 5 parts by volume of fibre to 1000 parts by volume of concrete. The fibres preferably have a diameter of not more than 0.05 mm and a length of not more than 40 mm. The concrete preferably has a compressive strength of not less than 30 MPA.

The anchor means 3 are 2 preferably upstanding shear transfer studs 3 fastened near to the ends of the tension members 2 in order to assist in the supporting and constraining of a compressive. arching action in the concrete. The lower surface 4 of the panel 1 is preferably upwardly arched or displaced from the bottom plane of the concrete body with the result that the tension members 2 are embedded, wholly or partially in the concrete over only a part of their length, vis, along their outer ends only. Consequently, the tension members are not embedded but are exposed over their intervening lengths between their respective ends.

As a preferred form of installation pair of laterally spaced beams 5 provide upper support surfaces 6 upon which spaced clusters of shear studs 7 are secured. The clusters of shear studs 7 are located within recesses formed in the edge load transfer surfaces 8 of the pre-cast concrete panel 1 and grouted in place. The laterally spaced beams 5 extend between spaced vertical supports (not shown) and may be connected at or near their ends by a laterally extending transverse bean 12.

Each laterally extending transverse beam 12 presents an upper support surface 13 upon which spaced clusters of shear studs 9 are secured. An end panel may be provided which has a transversely extending, lower end load transfer surface 10 at its end edge which is dimensioned to be located upon the upper support surface 13 of the transverse beam 12. The load transfer surface 10 contains recesses 14 into which the clusters of shear studs 9 mounted on the transverse beam 12 are introduced and located by grouting.

The end faces 11 of adjacent panels are preferably spaced some 20 mm to 25 mm apart and are roughened, the gap between the end faces 11 of adjacent panels is filled with high strength grout so as to provide a joint of good riding quality.

By reason of the embedment of the anchor means 3 of the tension members 2 within the panels 1, the outer, lower edge portions of the panels 1 are restrained from spreading when the panels 1 are loaded. This permits the formation of pre-cast panels 1 that may be delivered for positioning on beams 5 that have not been specially linked to ensure that an arching action develops and is preserved in the panels 1. This arching action is instead ensured by the presence of the tension members 2 delivered with the panels themselves.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. A pre-cast concrete panel intended for use in load supporting structures, said panel comprising:

(1) a concrete body defining two opposed, outer, lower edge portions for said panel that lie in a common bottom plane of the concrete body, said concrete body being impregnated with non-metallic, non-corrodible reinforcing fibres;

(2) a lower surface to said concrete body that is intermediate the opposed outer, lower edge portions of said concrete body; and (3) a spaced tension member spanning the width of said concrete body adjacent said lower surface, said tension member:

(a) having anchoring means carried by and extending transversely from said tension member at the outer ends of said tension member, said anchor means being embedded within the concrete body of said panel at said outer lower edge portions; and (b) having an intervening length extending between said outer ends that is not embedded within the concrete body of said panel; and (c) being positioned at or above said common bottom plane of the concrete body, whereby upon application of a vertical load to said panel, the tension member resists such loading by carrying tensile forces which support an arching action within the concrete body of the panel.

2. A pre-cast concrete panel according to claim 1 wherein the anchoring means comprise upstanding shear transfer studs carried at or near the ends of the tension member.

3. A pre-cast concrete panel according to claim 1 wherein the lower surface of the concrete body is arched, whereby the depth of concrete within said panels is greatest at said outer edge portions and in which the anchoring means of the tension member is embedded in the concrete in the regions of its greatest depth.

4. A pre-cast concrete panel according to claim 1 wherein said non-metallic fibres are distributed within the concrete with greater than 5 parts by volume of fibre to 1000 parts by volume of concrete.

5. A pre-cast concrete panel according to claim 1 having recesses formed in the outer, lower edge portions of said concrete body in combination with supporting beams having upper bearing surfaces which underlie the outer, lower edge portions of the concrete body, said supporting beams being provided with spaced clusters of shear studs secured to the upper bearing surfaces of said beams, said clusters of shear studs being located and grouted within said recesses.

6. A pre-cast concrete panel according to claim 5 for use as an end panel, comprising an end edge portion with a downwardly directed end load transfer surface extending laterally between said two opposed, outer lower edge portions and lying within the common bottom plane of the concrete body in combination with a transverse beam secured to and extending between said supporting beams wherein said end load transfer surface rests upon said transverse beam.

7. A pre-cast concrete panel according to claim 6 wherein said end panel is provided with end edge recesses formed in said end edge portion and is connected to said transverse beam by means of spaced clusters of shear studs secured to the upper surface of said transverse beam, said clusters of shear studs being located and grouted within said end edge recesses.

* * * * *